United States Patent [19]

Hashimoto

[11] 4,358,728

[45] Nov. 9, 1982

[54] VOLTAGE CONTROL CIRCUIT RESPONSIVE TO FET PROPAGATION TIME

[75] Inventor: Yukio Hashimoto, Tokorozawa, Japan

[73] Assignee: Citizen Watch Company Limited, Tokyo, Japan

[21] Appl. No.: 129,829

[22] Filed: Mar. 13, 1980

[30] Foreign Application Priority Data

Apr. 10, 1979 [JP] Japan ..... 54-43164

[51] Int. Cl.[3] ..... G05F 1/58

[52] U.S. Cl. ..... 323/275; 307/525; 323/907; 368/204

[58] Field of Search ..... 307/296 R, 297, 525; 323/273-275, 907; 368/156, 203-205

[56] References Cited

U.S. PATENT DOCUMENTS

| | | | |
|---|---|---|---|
| 3,688,202 | 8/1972 | Naubereit et al. | 307/525 |
| 4,015,218 | 3/1977 | Sanderson | 323/907 X |
| 4,232,261 | 11/1980 | Lingstaedt et al. | 323/275 |
| 4,244,043 | 1/1981 | Fujita et al. | 368/156 X |

*Primary Examiner*—A. D. Pellinen

*Attorney, Agent, or Firm*—Holman & Stern

[57] ABSTRACT

An electronic timepiece contains a supply voltage source which provides a supply voltage controlled in accordance with temperature, whereby power consumption is reduced by supplying the timepiece circuit with only the amplitude of supply voltage required at any particular operating temperature. Voltage control is performed in accordance with variations in propagation times of circuit elements with temperature, as determined by variations in the frequency of a ring oscillator circuit.

13 Claims, 18 Drawing Figures

VOLTAGE CONTROL CIRCUIT RESPONSIVE TO FET PROPAGATION TIME

BACKGROUND OF THE INVENTION

In virtually all portable electronic devices such as electronic timepieces, for which a very low level of power consumption is essential, integrated circuitry based on CMOS FET elements is utilized at present. Such circuit elements display various changes in their characteristics with variations in operating temperature. In particular, an increase in operating temperature results in a decrease in the threshold voltage of such an element, and a reduction in the propagation time. Such changes in characteristics can be compensated for by appropriately changing the supply voltage at which the circuitry is operated. Conversely, if the circuitry is operated at a fixed supply voltage, over a wide range of temperatures, then it will be necessary to apply an unnecessarily high level of supply voltage over a certain range of temperatures, in order to ensure satisfactory operation within some other temperature range. This results in wasteful consumption of battery power, since the minimum practicable supply voltage is not being applied to the circuitry at all times. In the case of certain portable electronic devices such as electronic timepieces, it is essential to reduce the battery consumption to as low a level as possible, in order to ensure maximum battery lifetime and to enable the timepiece size to be reduced by utilizing a battery of small dimensions (and hence relatively low capacity). There is therefore a requirement for some effective means for controlling the supply voltage applied to an electronic circuit, such as a timepiece circuit, in accordance with operating temperature, in such a way that the minimum supply voltage necessary for satisfactory operation of the circuit is provided at any temperature. Such control means is provided by the circuit of the present invention.

SUMMARY OF THE INVENTION

In the present invention, a supply voltage control circuit is provided within an electronic timepiece, which regulates the supply voltage applied to a major portion of the timepiece circuitry in accordance with operating temperature, to ensure that sufficient supply voltage will be applied to the circuitry at any operating temperature, but that an excessively high voltage is never applied. The supply voltage control circuit is based upon a ring oscillator circuit whose operating frequency varies in proportion to changes in operating temperature. Output signals from the ring oscillator circuit are combined with fixed frequency signals provided from a standard frequency oscillator circuit, to provide drive signals which are applied to a charge pump voltage control circuit, the output from which produces a supply voltage for the timepiece circuitry.

DESCRIPTION OF THE PREFERRED EMBODIMENT

Figure 1:
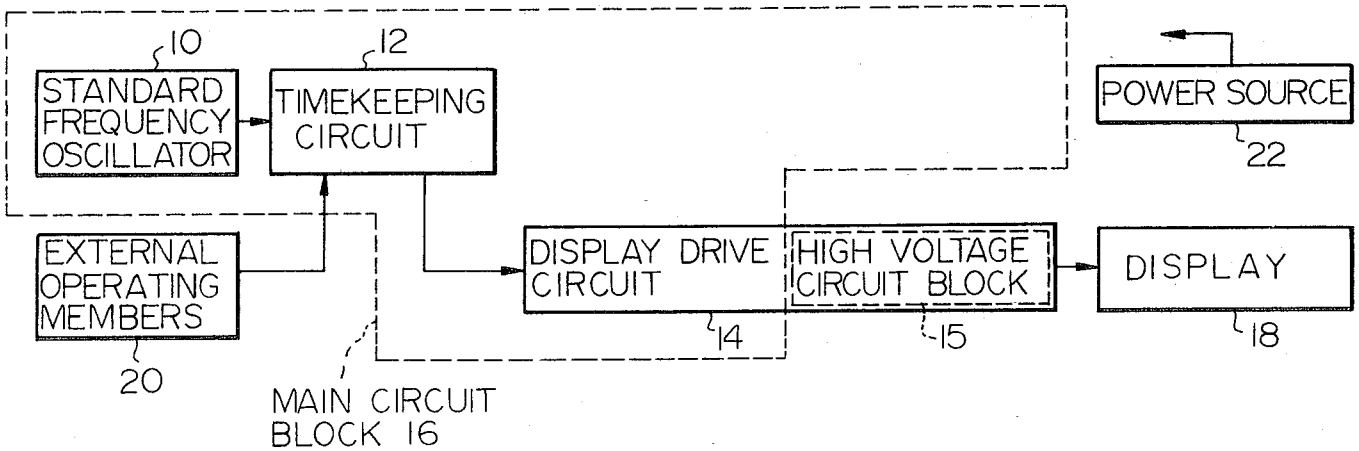
FIG. 1 is a block diagram illustrating the major components of an electronic timepiece.

Before describing an embodiment of the present invention, the general form of the circuitry of an electronic timepiece will be discussed, with reference to the block diagram of FIG. 1. The major portion of the timepiece circuitry is contained within a block designated by reference numeral 16, and will be referred to hereinafter as the main circuit block. The main circuit block is generally composed of CMOS FET circuit elements, and can operate at a relatively low voltage, supplied from a power source, 22. The main circuit block 16 is composed of a standard frequency oscillator circuit, which supplies a timebase signal to a timekeeping circuit 12. Time information signals from timekeeping circuit 12 are supplied to a display drive circuit 14, output signals from which are applied to a display 18. Parts of the display drive circuit 14, designated by a dotted line rectangle 15, must receive a higher supply voltage than the main circuit block 16, in order to drive the display 18. Numeral 20 denotes external operating members used to alter the contents of the timekeeping circuit 12.

In conventional electronic timepieces, it has been usual to supply the same voltage to the main circuit block 16 as is applied to the block 15 which requires a higher supply voltage. However, this is inefficient, since power from power source 22 (i.e. the timepiece battery) is dissipated unnecessarily.

Figure 2:
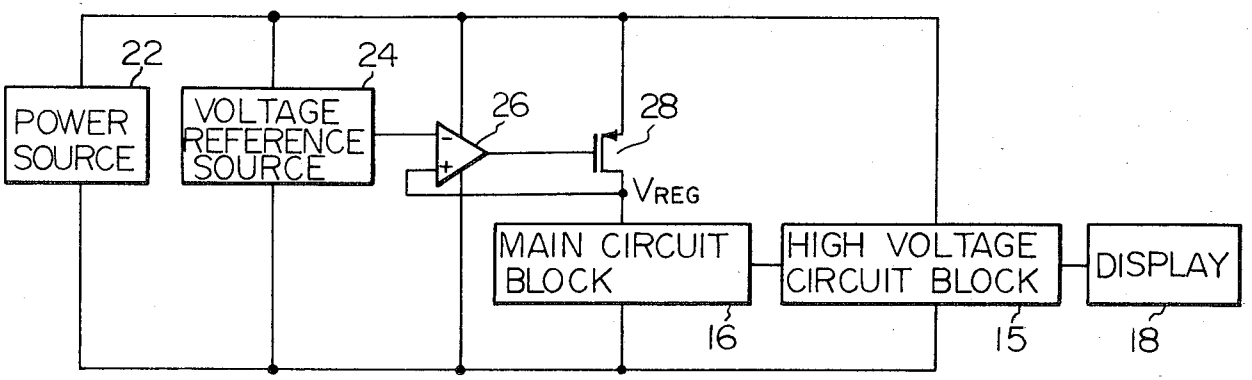
Fig. 2 PRIOR ART
FIG. 2 is a block diagram illustrating a prior art method of controlling the supply voltage applied to portions of the circuitry of an electronic timepiece.

It will be apparent that greater economy of use of power source 22 can be attained by providing a lower supply voltage to the main circuit block 16 than is applied to the high voltage circuit block 15. One method of achieving this is to utilize a voltage regulator circuit of conventional type to produce a lower supply voltage. However, one difficulty which is encountered if this is done is that it is not practicable to use a zener diode as a voltage reference source, in the case of a timepiece circuit, since the operating voltage levels are too low for operation of a zener diode. Since other active circuit elements than zener diodes generally display a significant change in characteristics with temperature, provision of a simple and effective voltage regulation circuit for an electronic timepiece is difficult to implement. An example of a modification of a timepiece circuit such as that of FIG. 1 to include a voltage regulator circuit is shown in FIG. 2. Here, a voltage reference source 24 provides a reference voltage which is compared with the output voltage from a voltage regulator transistor 28, by means of a comparator 26. The output voltage from the voltage regulator transistor 28, which is lower than the output from power source 22, is supplied to the main circuit block 16. The output voltage from power source 22 is applied directly to the high voltage circuit block 15, to provide signals for driving display 18.

Normally, the voltage reference source 24 is required to provide a reference voltage which is more or less constant with respect to changes in operating temperature, so that the output voltage from regulation transistor 28 is approximately constant with temperature. It would be desirable to have a reference voltage source whose output would vary with temperature in such a fashion as to provide an appropriate value of supply voltage from regulation transistor 28 for main circuit block 16 at various temperature. However this is difficult to achieve, due to variations in the response of CMOS FET circuit elements to changes in temperature. This can be illustrated by referring to FIG. 3, which shows a typical arrangement of CMOS FET elements used to provide a reference voltage (denoted as Vref). Such a circuit is frequently used in electronic timepieces. The source of a first P-channel MOS FET 30 is connected to the high potential of a power source, while the drain of this transistor is connected to an output terminal and to the source of a second P-channel MOS FET 32. The drain of transistor 32 is connected to the gate of that transistor, as well as to the gate and drain terminals of an N-channel MOS FET 34. The source of transistor 34 is connected to the low potential of the power source, and also to the circuit ground. It can be seen that transistors 34 and 32 are connected as diodes in series, while transistor 30 serves as a load.

Figure 3:
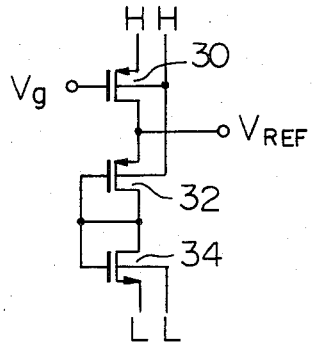
Fig. 3 PRIOR ART
FIG. 3 is a circuit diagram illustrating a voltage regulation circuit known in the prior art.
Figure 4:
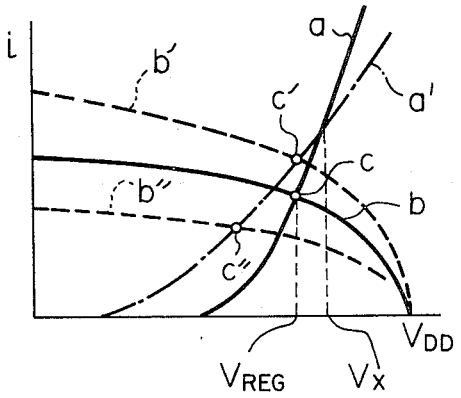
FIG. 4 is a graph illustrating the characteristics of the voltage regulation circuit of FIG. 3.

FIG. 4 is a graph illustrating the operation of the circuit of FIG. 3. Curve a represents the diode characteristic resulting from the combination of transistors 32 and 34. Curve b is the load characteristic presented by transistor 30. The output voltage Vref is therefore given by the point of intersection of curves a and b, i.e. point C. If the operating temperature of the voltage reference circuit increases, then the shape of curve a will be changed to that indicated as a'. It can be seen that, as the temperature increases, there will be an increase in current for values of output which are below a certain value, designated as Vx, while there will be an increase in current for values of output voltage which are above Vx. In other words, the temperature characteristic of the diode composed of transistors 32 and 34 is either positive or negative, depending upon the value of output voltage Vreg which is selected. The load curve presented by transistor 30, on the other hand, will change as shown by b' or b'', in accordance with whether the voltage applied to the gate of transistor 30, i.e. voltage Vg, is increased or decreased. Thus, for the case of the diode curve having shifted to become a', as a result of a change in temperature, the point of intersection with the load curve may be as indicated by C' or by C'', if there is a change in the value of voltage Vg. In other words, in order to ensure a predetermined temperature characteristic for the output voltage Vref from the circuit of FIG. 3, it is necessary to closely control the value of voltage Vg applied to the gate of transistor 30. This could be approximately achieved by providing voltage Vg from a preceding voltage regulator stage, or more accurately by utilizing a series of voltage regulator stages to produce voltage Vg. However this will result in greater circuit complexity, and of course in an increase in the power consumed from the timepiece power source, and is therefore obviously undesirable.

However, even if it were possible to easily provide a substantially constant voltage to be applied as Vg to the gate of transistor 30, various other problems arise due to differences between the characteristics of the transistors such as 30, 32 and 34. Manufacturing variations in these characteristics, from lot to lot, make it impractical to set the diode and load characteristics such that a predetermined type of temperature characteristic (zero, positive or negative) is achieved by causing the characteristics to intersect at some predetermined point (such as point C). Such variations will also of course result in variations in the value of the regulated output voltage produced, so that the desired advantage of reduced power consumption may not be substantially realized. Another difficulty which arises in practice from utilizing the method of FIGS. 2 to 4 is that, at the present state of technology, the characteristics of a differential amplifier (as denoted by numeral 26 in FIG. 2) manufactured as part of a CMOS FET circuit, are far from ideal. This factor further degrades the performance which can be achieved by utilizing a voltage regulation circuit of the type shown in FIG. 2.

The type of circuit known in the prior art and described above performs voltage regulation in a static manner. In the case of the present invention, however, control of a supply voltage is performed based upon changes in the dynamic characteristics of circuit elements with changes in temperature. In order to more clearly distinguish a circuit according to the present invention from a voltage regulation circuit based on static characteristics, as illustrated in FIG. 2, it will be referred to herein as a voltage control circuit.

Figure 5:
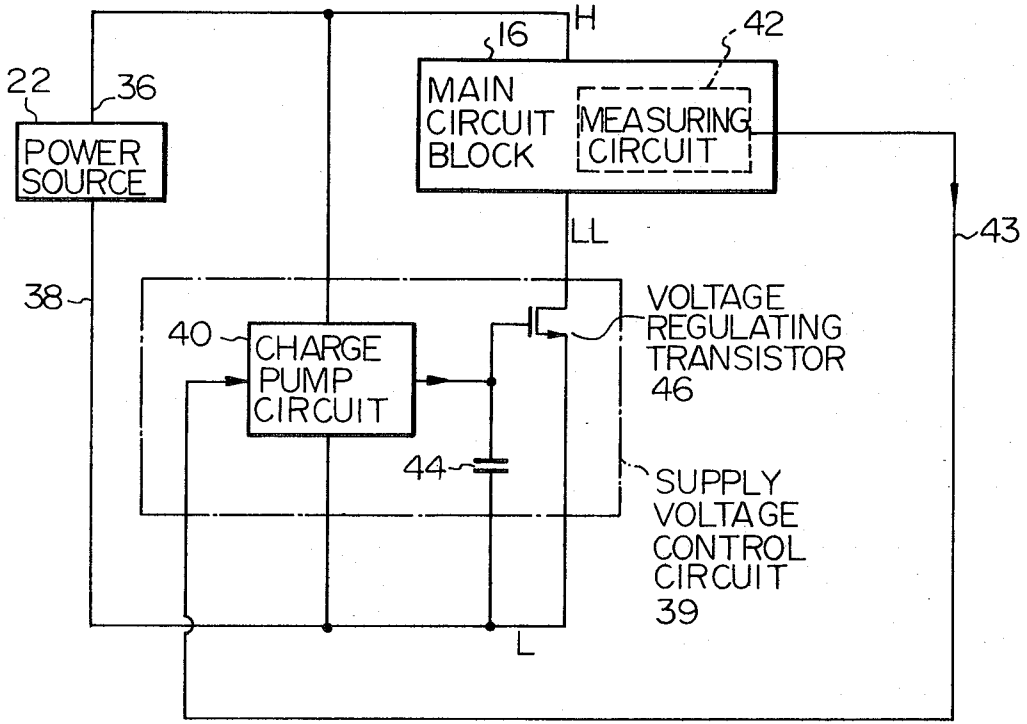
FIG. 5 is a simplified block diagram illustrating the general principles of supply voltage control circuit according to the present invention.

FIG. 5 is a simplified block diagram to illustrate the basic concepts of the present invention. Numeral 16 denotes the main circuit block of an electronic timepiece or other electronic device, which is to be operated at a lower level of supply voltage than is provided by a power source 22. The high potential output of power source 22, designated as H, is connected directly to one power supply terminal of circuit block 16, while the potential output of power source 22, designated as L, is connected to the other power supply terminal of circuit block 16 through a voltage regulating transistor comprising an N-channel MOS FET 46. The gate terminal of transistor 46 is connected to one end of a capacitor 44 and to the output of a charge pump circuit 40. A measuring circuit 42, contained within circuit block 16, detects changes in the propagation time of the transistor elements in circuit block 16, resulting from changes in operating temperature. If the propagation time should increase, then a signal is sent from measuring circuit 42 to charge pump circuit 40, resulting in a signal from charge pump 40 being applied to capacitor 44 such as to reduce the charge on capacitor 44 by a certain amount.

The voltage developed across capacitor 44, i.e. gate voltage Vc, is thereby reduced, thereby increasing the internal resistance (i.e. the effective resistance between drain and source) of transistor 46, so that the voltage supplied to circuit block 16 is reduced. If on the other hand, the propagation speed of the transistor elements in circuit block 16 should decrease, then the opposite process is performed, i.e. the charge on capacitor 44 is increased by a certain amount, thereby increasing the voltage supplied to circuit block 16. Thus, feedback control is performed by the combination of measuring circuit 42, charge pump circuit 40 and transistor 46 with capacitor 44, which constitute a voltage control system based upon detection of changes in the propagation speed of elements in circuit block 16. The propagation speed of the elements in circuit block 16 is therefore held constant. Alternatively stated, the voltage control circuit of the present invention maintains a sufficient level of supply voltage to circuit block 16 such that the propagation speed of the elements in circuit block 16 does not fall below a predetermined minimum value for effective operation of circuit block 16. In this way, application of an unnecessarily high level of supply voltage to circuit block 16 is avoided. Charge pump circuit 40, capacitor 44 and voltage regulating transistor 46, in combination, constitute a supply voltage control circuit 39. A voltage control circuit according to the present invention is essentially composed of measuring circuit 42 and supply voltage control circuit 39.

Figure 6:
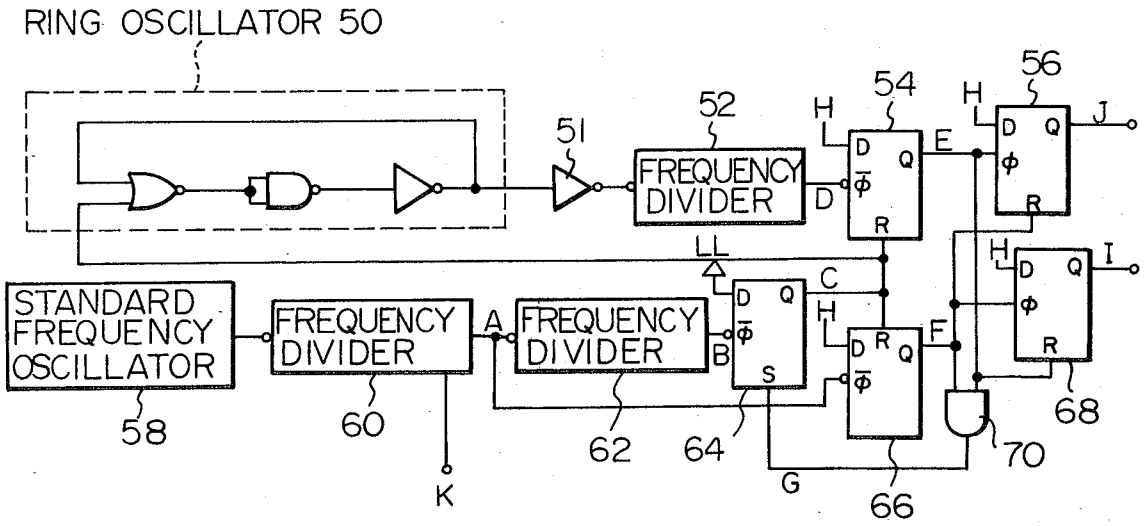
FIG. 6 is a general circuit diagram illustrating an embodiment of a temperature measuring circuit according to the present invention, for producing control signals to be applied to a charge pump voltage control circuit.

An embodiment of measuring circuit 42 of FIG. 5 is shown in FIG. 6, in simplified circuit diagram form. Here, a primary oscillator circuit, designated by reference numeral 58, provides an output signal which is of constant frequency, with respect to variations in operating temperature and supply voltage. In the case of an electronic timepiece, primary oscillator 58 could readily be constituted by the standard frequency quartz crystal oscillator circuit of the timepiece. A secondary oscillator 50 provides an output signal having a frequency which varies with changes in operating temperature. In this embodiment, secondary oscillator 50 is composed of a ring oscillator circuit. The period of the output signal from ring oscillator 50 varies in accordance with changes in the propagation speed of the elements of which it is composed, as the operating temperature varies. This output signal is applied through a buffer stage 51 to a frequency divider circuit 52. The output of frequency divider 52 is applied to the clock input terminal of a flip-flop 54. ("Flip-flop" will be abbreviated hereinafter to FF). The output E from FF 54 is applied to the clock input terminal of another FF 56, to one input terminal of an AND gate 70, and to the reset input terminal of FF 68. Output J of FF 56 is applied to charge pump circuit 40 as a discharge signal, to lower the voltage developed across capacitor 44 (in FIG. 5).

The output signal from primary oscillator 58 is supplied to a frequency divider 60, the output A from which is applied to input terminals of another frequency divider 62 and of FF 66. Output B from frequency divider 62 is applied to the clock input terminal of an FF 64. The output C from FF 64 is applied to the control input terminal of ring oscillator 50, and to the reset input terminals of FF 54 and FF 66. Output F from FF 66 is applied to the other input terminal of AND gate 70, to the reset input terminal of FF 56, and to the clock input terminal of FF 68. The output signal I from FF 68 is applied to charge pump 40 as a charge signal, which causes an increase in the potential developed across capacitor 44.

The data input terminal of FF 64 is connected to the output from control transistor 46, designated as LL (see FIG. 5). The set input terminal of FF 64 is connected to the output G from AND gate 70. The data input terminals of FF 54, FF 56, FF 66 and FF 68 are each connected to the high potential H.

The operation of the circuit of FIG. 6, as well as that of FIG. 7 (described hereinbelow) can be understood by reference to the waveform diagram of FIG. 8. The output signal from primary oscillator 58 is of fixed frequency, so that an output signal A of predetermined fixed period To is produced from frequency divider 60. Signal A is applied to frequency divider 62, which produces an output signal B having period $T_1$.

While ring oscillator 50 is in the inoperative state, FF 64 is in the set state, so that FF 54 and FF 66 are in the reset state. When signal B goes from the high to the low logic level potential (referred to hereinafter as the H and LL levels respectively), the FF 64 output signal C goes to the LL level, since this potential is applied to the data input terminal of FF 64. Operation of ring oscillator 50 is thereby enabled. Subsequently, signal A will go to the H level as shown, and then return to the LL level after a time To following the initiation of operation by ring oscillator 50. Similarly, signal D will go to the H level, and return to the LL level, but at a time which is determined by the oscillation frequency of ring oscillator 50. In this embodiment, the division ratios of frequency dividers 52, 60 and 62 are established such that at some predetermined operating temperature value, the signal D from frequency divider 52 will return to the LL level at the same time as signal A, i.e. after a period To following the initiation of oscillation by ring oscillator 50.

If the temperature varies with respect to the predetermined value referred to above, then the frequency of operation of ring oscillator 50 may either increase or decrease with an increase in temperature, i.e. the temperature coefficient may be either positive or negative, depending upon factors to be explained hereinafter. However, in any case, an increase in the supply voltage applied to ring oscillator 50 will result in a reduction of the period of oscillation, while a lowering of the supply voltage will cause an increase in the period. It will therefore be apparent that the period of oscillation can be held to a constant value by suitably varying the level of supply voltage applied to ring oscillator 50, to compensate for the effects of temperature variations.

If the period of oscillation of ring oscillator 50 should increase, due to a temperature change, then the point at which signal D goes from the H to the L level will be delayed relative to the H-to-LL level transition of signal A. The output of FF 66 will thereby be caused to go to the H level. At this time, signal E is at the LL level, so that the output I of FF 68 is caused to go to the H level. Subsequently, when signal D goes from the H to LL level, the output E of FF 54 is caused to go to the H level. At this time, signal F is at the H level, so that FF 56 is held in the reset state and its output signal J remains at the LL level. FF 68 has been reset, so that output G from AND gate 70 goes to the H level, thereby setting FF 64. Signal C is thereby caused to return to the H level, so that the initial state is restored, in which operation of ring oscillator 50 is inhibited.

The signal I produced by FF 68 is applied to charge pump circuit 40 as a charge signal, causing an increase in the charge on capacitor 44, so that the internal resistance between drain and source of transistor 46 is decreased. The supply voltage applied to ring oscillator 50 is thereby increased, causing a reduction in the period of oscillation, to thereby compensate for the detected increase in that period.

In a similar manner, if the period of oscillation of ring oscillator 50 should decrease, so that signal D undergoes a transition from the H to the LL level at a point in time which leads the H-to-LL level transition of signal A, after operation of ring oscillator 50 has been initiated, then a signal J produced by FF 56 will be applied to charge pump 40 as a discharge signal. The charge on capacitor 44 is thereby reduced, causing an increase in the drain-to-source resistance of transistor 46, so that the supply voltage applied to ring oscillator 50 is reduced, tending to increase the period of oscillation.

It will thus be appreciated that the circuit of FIG. 6, utilized as shown in FIG. 5, controls the supply voltage applied to ring oscillator 50 such as to hold the period of oscillation of ring oscillator 50 substantially constant. Since the period of oscillation of ring oscillator 50 is determined by the propagation time of each of the transistor elements of which it is composed, it can be seen that the propagation time of other transistor elements of the integrated circuit containing ring oscillator 50 can be held substantially constant against variations due to temperature changes, by automatic feedback control of the supply voltage, i.e the voltage (H-LL).

Figure 7:
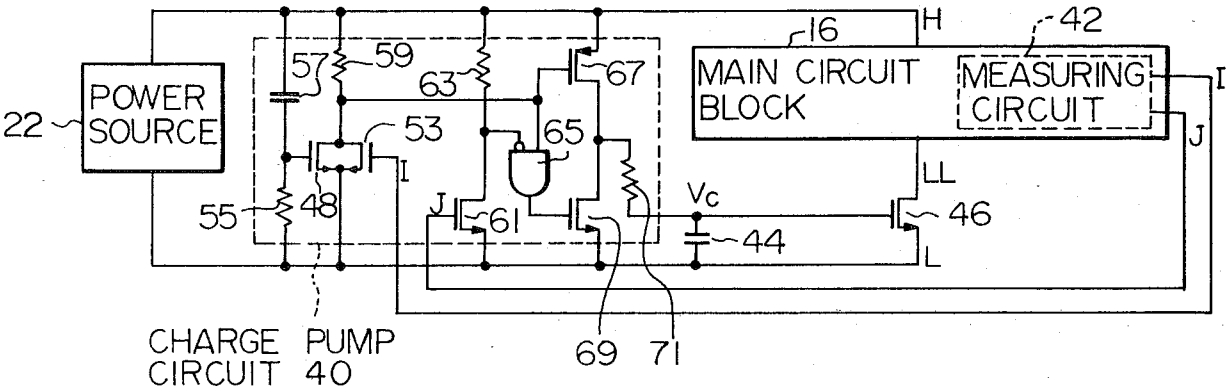
FIG. 7 is a circuit diagram of a charge pump voltage control circuit which receives signals produced by the circuit of FIG. 6.

An embodiment of charge pump circuit 40, controlled by signals I and J from the circuit of FIG. 6, is shown in FIG. 7. Here, charge and discharge signals I and J are applied to the gate terminals of N-channel transistors 53 and 61 respectively. The drain of transistor 53 is connected to the H level of power source 22 through a resistor 49, and also to the gate of a P-channel transistor 67 and the normal (i.e. non-inhibit) input of an inhibit gate 65. The inhibit input terminal of inhibit gate 65 is connected to the drain of transistor 61, and also to the H level of power source 22 through a resistor 63. The output of inhibit gate 65 is connected to the gate of an N-channel transistor 69, the drain of which is connected to the drain of transistor 67, and is also connected through a resistor 71 to the gate terminal of N-channel transistor 46 and to one terminal of capacitor 44. The other terminal of capacitor 44 is connected to the L potential of power source 22. Transistors 53 and 48, in conjunction with resistors 59 and 63 constitute a level-shifter circuit. Inhibit gate 65 serves to eliminate the danger that transistors 67 and 69 may be both turned to the on state (i.e. the conducting state) when power source 22 is switched on, or for any other reason. If the gate potential of transistor 67 goes to the L level due to the charge signal I going to the H level, the gate potential of transistor 69 will go to the L level. Thus, transistor 69 will be prevented from entering the on state.

Resistor 55 and capacitor 57, together with transistor 48, serve to establish an initial operating condition for the circuit when power source 22 is switched on. Prior to power source 22 being switched on, capacitor 57 is in a discharged state. Thus, when power source 22 is switched on, the gate potential of transistor 48 goes to the H level and the gate potential of transistor 67 therefore goes to the L level, thereby turning on transistor 67. Capacitor 44 thereby begins to charge through resistor 71, irrespective of the levels of signals I and J. Transistor 46 is therefore turned on, so that the full voltage of power source 22 is applied to circuit block 16, thereby initiating operation of circuit block 16 in a reliable manner. Subsequently, capacitor 57 becomes charged through resistor 55, so that transistor 48 becomes turned off when its gate potential approaches the L level. Thereafter, the gate potential of transistor 46 is controlled by signals I and J from the measurement circuit of FIG. 6, as described above.

Figure 9:
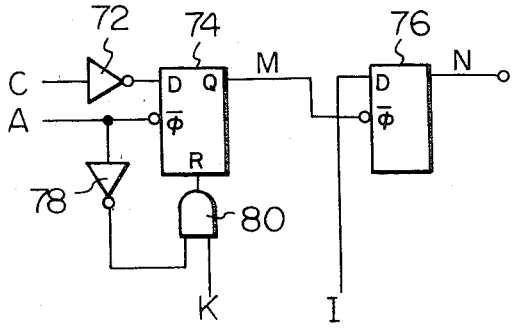
FIG. 9 is a circuit diagram of a modification of part of the circuit of FIG. 6.

A modification which may be added to the circuit of FIG. 6 is shown in FIG. 9. The circuit of FIG. 9 is designed to generate a warning signal when the voltage of power source 22 falls below a certain minimum value beyond which control cannot be maintained by the voltage control circuit of FIG. 6 and FIG. 7. The letters A, C, I and K in FIG. 9 designate signals shown in FIG. 6 by corresponding letters. Here, signal C is applied through an inverter 72 to the data terminal of FF 74, while signal A is applied to the clock terminal of FF 74 and through an inverter 78 to one input of an AND gate 80. Signal K is applied to the other input of AND gate 80, the output of which is coupled to the reset input of FF 74. The Q output of FF 74, designated as signal M, is applied to the clock input of another FF 76. Signal I is applied to the data input terminal of FF 76, the output of which is designated as signal N.

Figure 8:
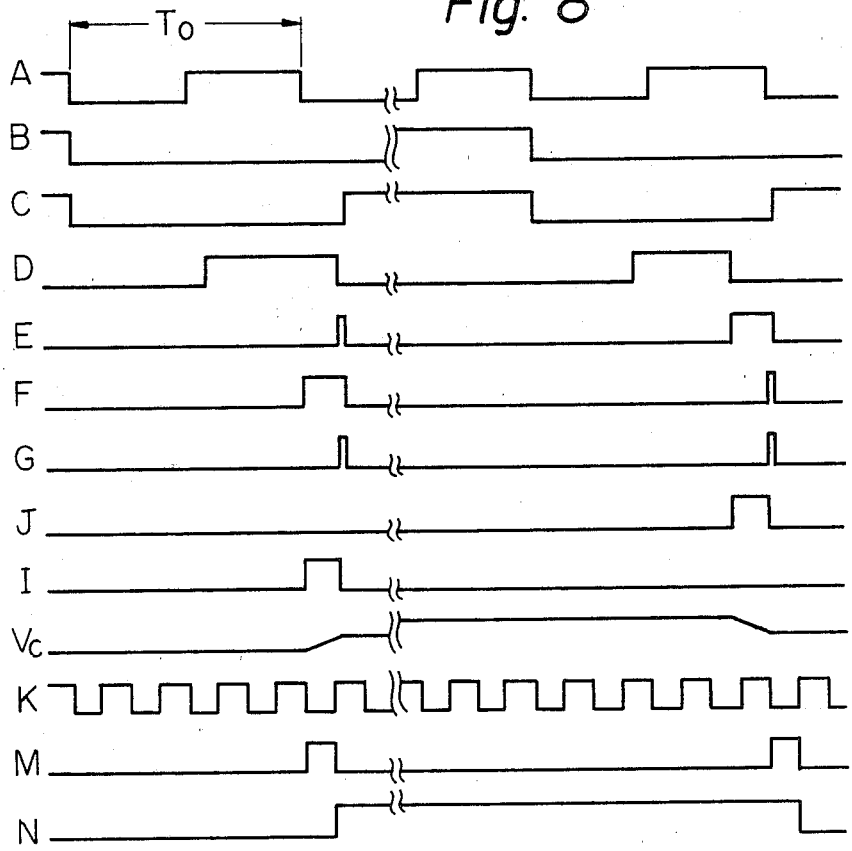
FIG. 8 is a waveform diagram illustrating the operation of the circuits of FIG. 6 and FIG. 7.

The waveforms of the various signals of the circuit of FIG. 9 are shown in FIG. 8. Each time that signal A goes from the H to the LL level, while signal C is at the LL level, output M of FF 74 goes to the H level. While signal A is at the LL level, FF 74 is reset when signal K goes to the H level, thereby causing signal M to go to the LL level. When signal M goes from the H to the LL level, the state of signal I is read into FF 76. It is a feature of the circuit of FIG. 6 that, while the voltage supplied by power source 22 is above a certain minimum value, the width of each pulse of signal I is relatively narrow. When the voltage from power source 22 falls below this minimum value, the width of the pulses of signal I suddenly increased considerably in duration. Thus, by suitably selecting the period of signal K to provide an appropriate timing for signal M supplied to FF 76 clock terminal, an increase in the duration of signal I beyond a predetermined value can be detected by the output signal N going to the H level. This condition of signal N can be used to actuate an alarm warning, etc to indicate that the voltage of power source 22 has fallen below a value at which control can be maintained by the voltage control circuit of the present invention.

In the embodiment described above, the circuit of FIG. 6 is supplied with the controlled voltage (H-LL) produced from the circuit of FIG. 7, while the circuitry in FIG. 7 is operated at the full supply voltage level (H-L) supplied by voltage source 22. How it is easily possible to modify this arrangement, such that, for example, parts of the circuit of FIG. 7 are supplied with the controlled voltage. This can be done by providing suitable voltage level shifting modifications.

Figure 10:
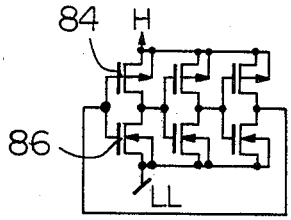
Fig. 10 PRIOR ART
FIG. 10 is a circuit diagram of a ring oscillator of conventional type.
Figure 11A:
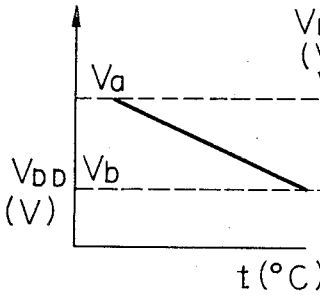
FIGS. 11A and 11B are graphs illustrating the relationships between supply voltage, temperature and operating frequency, for a ring oscillator circuit utilizing CMOS FET elements.
Figure 11B:
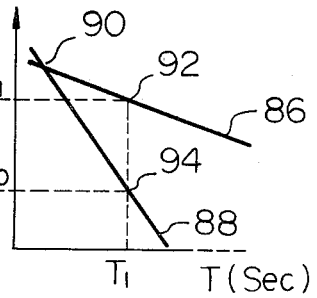

The design of a ring oscillator circuit for use in a voltage control circuit according to the present invention will now be considered. Specific means for inhibiting or enabling operation of the oscillator, such as the use of a NOR gate as in the case of the ring oscillator circuit 50 in FIG. 6 above, will not be considered here. FIG. 10 shows a basic ring oscillator circuit composed of three CMOS FET inverter stages. FIG. 11A shows the form of the relationship required between the output voltage of a voltage control circuit according to the present invention (i.e. voltage (H-LL) in FIG. 7) and ambient operating temperature t. As the temperature increases, the threshold voltage of the transistors in a CMOS FET circuit decreases in an approximately linear manner, as indicated in FIG. 11A. In order to ensure satisfactory operation of the circuit, it is necessary that the supply voltage provided thereto be higher than this threshold voltage by some minimum margin. In FIG. 11A it is assumed that the level of this supply voltage (designated in general as Vdd) must have a value of at least Va at a temperaure of −40° C., and a value of at least Vb at a temperature of +80° C. FIG. 11B shows the relationship between the supply voltage Vdd at which a CMOS FET ring oscillator is operated, the period of oscillation $T_1$, and the ambient operating temperature. Numeral 86 denotes the relationship between supply voltage and period at a temperature of −40° C., while numeral 94 denotes the relationship for a temperature of +50° C. It can be seen that for the case shown in FIG. 11B, a change in supply voltage from Va to Vb will cause the period $T_1$ to be maintained constant for a change in ambient temperature from −40° C. to +50° C. This is an ideal case, in which the change in supply voltage Vdd required to maintain satisfactory operation of the supplied circuit over the maximum operating temperature range is equal to the change in supply voltage required to hold the ring oscillator period constant over the full temperature range. However in the case of a simple ring oscillator circuit of conventional form, as illustrated in FIG. 10, the characteristics 86 and 88 of FIG. 11B will be lower with respect to the voltage axis, i.e. the voltage at point 90, representing a value at which the period of oscillation of the ring oscillator is constant with respect to temperature variations, will be lower. Thus, the range of voltage control of the ring oscillator circuit which provides a constant oscillation period with respect to temperature, will be narrower than (Va-Vb), for the case of a device such an an electronic timepiece in which the supply voltage is of the power source is of the order of 1.5 V, and in which the threshold voltage of the CMOS FET stages is of the order of 0.5 V at normal temperatures. In addition, a lowering of the voltage at point 90 in FIG. 11B results in the period of oscillation being shorter, for a given level of supply voltage Vdd. This is a serious disadvantage, since a long period of oscillation of the ring oscillator circuit enables the amount of frequency divider stages such as those of frequency divider 52 in FIG. 6, to be reduced.

The above disadvantages of the simple ring oscillator circuit can be alleviated by utilizing CMOS FET stages of higher threshold voltage in the ring oscillator circuit. This will result in a shift of the characteristics shown in FIG. 11B upward parallel to the voltage axis, i.e. the voltage at point 90 will be increased. However, for reasons of ease and economy of manufacture, it is highly undesirable to provide different values of threshold voltage in particular parts of a CMOS FET integrated circuit. Such a procedure increases the number of steps required in the manufacturing process, and lowers the yield, thereby substantially increasing the cost of manufacture. However, according to the present invention, the effective threshold voltage of the stages in a CMOS FET ring oscillator circuit can be increased as required, without providing a special value of threshold voltage for the transistors within the ring oscillator circuit. The region of effective voltage control of the ring oscillator period can thus be increased to a suitable value, such as is indicated as (Va-Vb) in FIGS. 11A and 11B.

Figure 12:
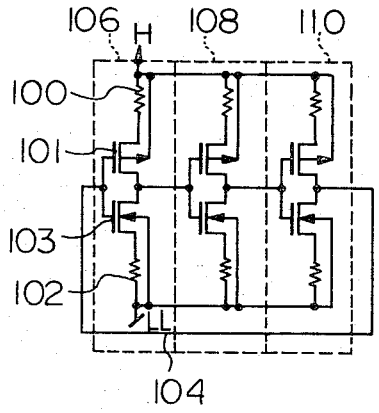
FIG. 12 is a circuit diagram of a ring oscillator circuit modified in accordance with the present invention to provide an increased frequency control range.

Referring first to FIG. 12, a first embodiment of a ring oscillator circuit of improved design for use in a voltage control circuit according to the present invention is shown. This oscillator is composed of three identical stages, 106, 108 and 110 respectively. In each of these stages, a resistor is connected between the source electrode of each transistor of the stage and the corresponding supply lead. For example, resistor 100 is connected between the source of transistor 101 in stage 106 and the H potential. Resistor 102 is connected between the source of transistor 103 and the LL potential. These resistors contribute to increasing the effective threshold voltage of the stage in two ways. Firstly, since the bulk of the semiconductor material from which the transistor is formed is connected to the corresponding supply voltage line (i.e. to potential LL in the case of transistor 103 and to potential H in the case of transistor 101) a reverse voltage is applied between the bulk and the source electrode, when the transistor is turned on. This reverse bias voltage causes channel modulation, which results in a higher level of threshold voltage. In addition, when a transistor is turned on by an applied gate voltage, the effective voltage appearing between the gate and source electrodes is equal to the applied gate voltage minus the voltage drop across the source resistor (i.e. across resistor 100 or 102). This further contributes to increasing the threshold voltage of each stage of the oscillator.

Figure 13A:
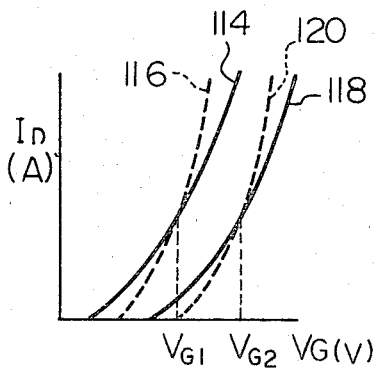
FIGS. 13A and 13B are graphs illustrating the advantages of an oscillator circuit such as that of FIG. 12.
Figure 13B:
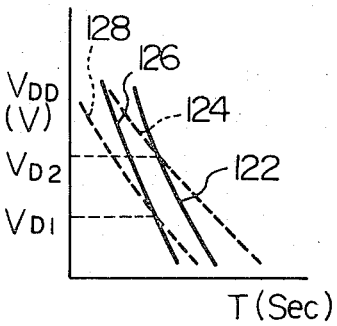

FIG. 13A is a graph of characteristic curves of drain current Id against gate voltage Vg, for a CMOS FET transistor. Curves 114 and 116 show the characteristics at a high operating temperature and at normal temperature respectively. Curves 118 and 120 show the characteristics at high temperature and normal temperature respectively, for the case in which a resistor is connected between the source electrode of the transistor and the supply line, as shown in FIG. 12. The characteristics show a well-known feature of CMOS FET transistors, namely that below a certain voltage, such as $V_{g1}$ or $V_{g2}$, the drain current increases with a rise in temperature, while below such a voltage, the drain current decreases with an increase in temperature. It can be seen that $V_{g2}$, which applies in the case of a resistor being connected between source and power line, is higher than $V_{g1}$. Referring now to FIG. 13B, the relationship between the supply voltage applied to a ring oscillator circuit and the period of oscillation is shown, for the case of a circuit such as that of FIG. 10 above, as designated by numerals 126 and 128, and in the case of a circuit in which resistors are connected in the source lead of each transistor as shown in the circuit of FIG. 12, as designated by numerals 122 and 124. Curves 122 and 126 apply to the case of a high operating temperature, while curves 124 and 128 apply to operation at normal temperature. It can be seen that the voltage levels $V_{d1}$ and $V_{d2}$, at which the period of oscillation is independent of temperature, correspond to the voltage levels $V_{g1}$ and $V_{g2}$ of the graphs in FIG. 13A. In other words, by connecting a resistor between source and power lead of each transistor of the ring oscillator circuit, as shown in FIG. 12, the voltage $V_{d2}$ at which operation is independent of temperature changes (corresponding to point 90 in FIG. 11B) is increased in value. As a result, the effective range of voltage control of the ring oscillator period is substantially increased, as explained hereinabove, as compared with the case in which source resistors are not connected to the ring oscillator circuit. In other words, by suitable selection of the value of resistors 100 and 102 shown in FIG. 12, the characteristics of oscillation period/supply voltage can be set such that a variation in supply voltage with temperature such as that indicated in FIG. 11A (i.e. from supply voltage $V_a$ to $V_b$) will cause the period of oscillation of the ring oscillator to remain substantially constant. It can be seen that this fact enables a voltage control circuit according to the present invention, based upon detection of variations of the period of oscillation of a ring oscillator circuit with temperature, to be implemented in a practicable manner, without the necessity for any special adjustment of the characteristics of the transistor elements constituting the ring oscillator circuit.

Figure 14A:
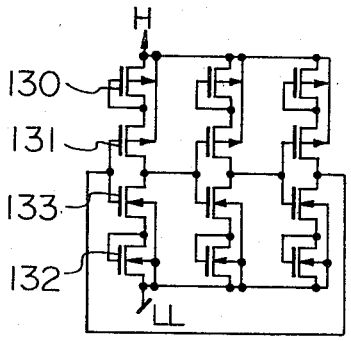
FIGS. 14A, 14B and 14C are circuit diagrams of other ring oscillator circuits modified in accordance with the present invention.
Figure 14B:
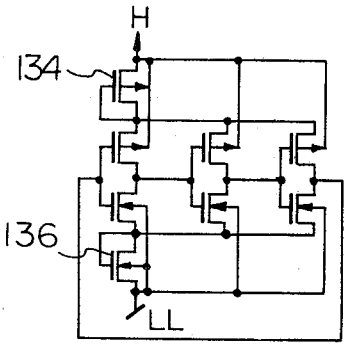

Instead of employing resistors such as 100 and 102 in the circuit of FIG. 12 to develop a reverse bias voltage between source and gate of the transistors in a ring oscillator circuit, it is also possible to utilize transistors connected as resistive elements. One example of this is shown in FIG. 14A. Here, transistors such as are designated by numerals 130 and 132 perform the same function as has been explained hereinabove with respect to resistors 100 and 102 in the circuit of FIG. 12. In this case, the amount of reverse bias voltage developed is determined by the threshold voltage of the transistors 130 and 132. Instead of using individual resistors or transistors in the source lead of each transistor of a ring oscillator circuit, it is also possible to a single resistor (or transistor) connected in common between the source leads of all of the N-channel transistors of the oscillator circuit and the corresponding power supply lead and another signal resistor (or transistor) connected in common between the source leads of all of the P-channel transistors of the oscillator circuit. This is illustrated in FIG. 14B, in which reverse bias voltages to increase the effective threshold voltage of each stage of a ring oscillator circuit are developed across transistors 134 and 136.

Figure 14C:
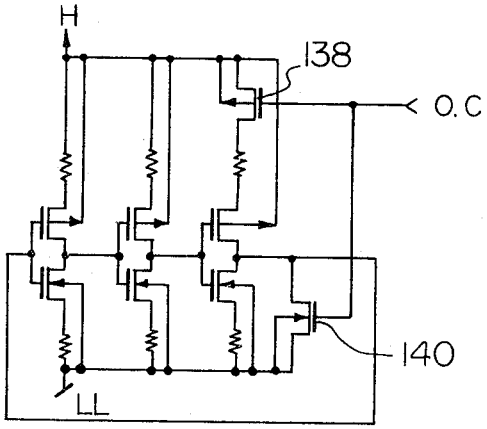

FIG. 14C illustrates a simple arrangement whereby a ring oscillator circuit according to the present invention can be driven in an intermittent manner, to reduce the power consumed thereby. This is accomplished by a control signal OC acting upon control transistors 138 and 140. It is equally possible to perform such a drive control function by utilizing standard logic gate circuits, as is done in the case of the circuit of FIG. 6, described hereinabove.

From the above description, it will be appreciated that the present invention enables the supply voltage applied to the circuits of an electronic device such as an electronic timepiece to be controlled in accordance with variations in ambient operating temperature in such a manner that an unnecessarily high level of supply voltage is avoided, while ensuring a sufficiently high level of supply voltage for satisfactory operation of the circuit. The method of control, based upon the variation in oscillation period of a ring oscillator composed of the same type of transistor elements as are utilized in the circuit being controlled, is highly suitable for application to the manufacture of CMOS FET integrated circuits. This is because the ambient operating temperature/oscillation period characteristics of such a ring oscillator circuit are consistently repeatable in the manufacturing process, being essentially determined by the threshold voltage characteristics of the transistors in the ring oscillator circuit. In addition, as described hereinabove, the effective threshold voltage of the stages of a ring oscillator circuit can be set to a suitable value without any modification to the actual transistor elements used in the ring oscillator circuit. This enables the operating temperature/oscillation period characteristics to be predetermined to be suitable for use in a voltage control circuit according to the present invention, with no change in the actual process of manufacturing the integrated circuits of the electronic device concerned. The present invention therefore presents significant advantages over prior art methods which have been proposed for controlling the supply voltage applied to particular circuit portions of an electronic device such as an electronic timepiece.

Although the present invention has been shown and described with respect to particular embodiments, it should be noted that various changes and modifications to these embodiments are possible, which fall within the scope claimed for the present invention.

What is claimed is:

1. A voltage control circuit for producing a controlled supply voltage, comprising:

a supply voltage source;

a primary oscillator circuit for producing a fixed frequency output signal whose frequency is independent of changes in ambient operating temperature;

a ring oscillator circuit comprising a plurality of field effect transistors, and responsive to changes in propagation time of said field effect transistors with temperature variations for producing an output signal whose frequency varies with respect to ambient operating temperature;

comparator circuit means for comparing the periods of oscillation of said primary oscillator circuit and said ring oscillator circuit for thereby producing output signals indicative of changes in the period of oscillation of said ring oscillator circuit resulting from changes in ambient operating temperature; and supply control circuit means coupled to receive a supply voltage from said supply voltage source and to receive said output signals from said ring oscillator circuit, and responsive to said output signals from said ring oscillator circuit for controlling said supply voltage to produce said controlled supply voltage, said controlled supply voltage being applied to said field effect transistors of said ring oscillator circuit such as to compensate said changes in propagation time of said field effect transistors;

wherein a resistive element being connected between the source electrode of each of said field effect transistors in said ring oscillator circuit and one potential of said controlled supply voltage, for thereby increasing the effective threshold voltage of said field effect transistors.

2. A voltage control circuit according to claim 1, wherein said resistive elements comprise field effect transistors connected in diode configuration.

3. A voltage control circuit according to claim 1, in which said ring oscillator comprises a plurality of inverter stages, with each of said inverter stages including a P-channel metal oxide silicon field effect transistor and an N-channel metal oxide silicon field effect transistor connected in series.

4. A voltage control circuit according to claim 1, in which said ring oscillator circuit includes at least one logic gate circuit composed of metal oxide silicon field effect transistors.

5. A voltage control circuit according to claim 1, in which said comparator circuit means produces a first output signal indicative of an increase in ambient operating temperature and a second output signal indicative of a decrease in ambient operating temperature.

6. A voltage control circuit according to claim 5, in which said supply control circuit means comprise:

a charge pump circuit composed of a capacitor and circuit means responsive to said first output signal from said comparator circuit means for increasing a charge on said capacitor and responsive to said second output signal from said comparator circuit means for decreasing said charge on the capacitor; and a voltage regulating transistor responsive to a voltage developed across said capacitor for regulating said supply voltage from said supply voltage source to produce said controlled supply voltage.

7. A voltage control circuit according to claim 6, in which said first and second output signals from said comparator circuit means comprise pulses of variable duration, with the pulse duration thereof being proportional to the amount by which the period of oscillation of said ring oscillator circuit departs from a predetermined period of oscillation.

8. A voltage control circuit according to claim 7, and further comprising circuit means responsive to said fixed frequency signal from said primary oscillator circuit for controlling said ring oscillator circuit to operate in an intermittent manner.

9. A voltage control circuit according to claim 8, and further comprising circuit means for detecting an increase in the period of oscillation of said ring oscillator circuit beyond a predetermined period of oscillation and for producing an output signal indicative thereof.

10. A voltage control circuit according to claim 7, and further comprising circuit means coupled to said charge pump circuit for detecting an initial application of a supply voltage from said supply voltage source to said charge pump circuit, and for thereby setting the state of charge upon said capacitor of said charge pump circuit to a level whereby said controlled supply voltage attains a predetermined value irrespective of said first and second signals from said comparator circuit means for a predetermined time interval subsequent to said initial application of said supply voltage.

11. A voltage control circuit for producing a controlled supply voltage, comprising:

measuring circuit means including a plurality of field effect transistors, for detecting changes in propagation time of said field effect transistors and for producing output signals indicative of such detected changes in propagation time;

a supply voltage source;

a charge pump circuit composed of a capacitor and circuit means responsive to said output signals from said measuring circuit means for selectively increasing and decreasing a charge on said capacitor; and wherein said measuring circuit means comprise:

a ring oscillator circuit including at least one logic gate circuit as one stage thereof;

a first frequency divider circuit coupled to receive an output signal produced by said ring oscillator circuit;

a first data-type flip-flop coupled to receive an output signal from said first frequency divider circuit at a clock input terminal thereof and having a data input terminal coupled to a first logic level potential;

a second data-type flip-flop having a clock input terminal coupled to receive an output signal from said first data-type flip-flop and a data input terminal coupled to said first logic level potential;

a standard frequency oscillator circuit producing a signal of predetermined period;

a second frequency divider circuit coupled to receive said output signal from said standard frequency oscillator circuit;

a third frequency divider circuit coupled to receive an output signal from said third frequency divider circuit and having a data input terminal coupled to a second logic level potential;

a fourth data-type flip-flop having a clock input terminal coupled to receive an output signal from said second frequency divider circuit and having a data input terminal coupled to said first logic level potential;

a fifth data-type flip-flop having a clock input terminal coupled to receive an output signal from said frouth data-type flip-flop, having a data input terminal coupled to said first logic level potential and having a reset input terminal coupled to receive said output signal from said first data-type flip-flop; and an AND logic gate coupled to receive said output signals from said first and fourth data-type flip-flops and having an output terminal coupled to a set input of said third data-type flip-flop;

an output signal from said third data-type flip-flop being applied to reset terminals of said third and fourth data-type flip-flops and to an input of said logic gate circuit in said ring oscillator circuit to be periodically and intermittently enabled to oscillate, an output signal from said second data-type flip-flop being applied as a charge signal to said charge pump circuit to cause discharging of said capacitor therein, and an output signal from said fifth data-type flip-flop being applied as a charge signal to said charge pump circuit to cause charging of said capacitor.

12. A voltage control circuit for producing a controlled supply voltage, comprising:

a supply voltage source;

a primary oscillator circuit for producing a fixed frequency output signal whose frequency is independent of changes in ambient operating temperature;

a ring oscillator circuit comprising a plurality of field effect transistors, and responsive to changes in propagation time of said field effect transistors with temperature variations for producing an output signal whose frequency varies with respect to ambient operating temperature;

comparator circuit means for comparing the periods of oscillation of said primary oscillator circuit and said ring oscillator circuit for thereby producing output signals indicative of changes in the period of oscillation of said ring oscillator circuit resulting from changes in ambient operating temperature; and supply control circuit means coupled to receive a supply voltage from said supply voltage source and to receive said output signals from said ring oscillator circuit, and responsive to said output signals from said ring oscillator circuit for controlling said supply voltage to produce said controlled supply voltage, said controlled supply voltage being applied to said field effect transistors of said ring oscillator circuit such as to compensate said changes in propagation time of said field effect transistors.

13. A voltage control circuit for producing a controlled supply voltage, comprising:

a supply voltage source;

a primary oscillator circuit for producing a fixed frequency output signal whose frequency is independent of changes in ambient operating temperature;

a ring oscillator circuit comprising a plurality of field effect transistors, and responsive to changes in propagation time of said field effect transistors with temperature variations for producing an output signal whose frequency varies with respect to ambient operating temperature;

comparator circuit means for comparing the periods of oscillation of said primary oscillator circuit and said ring oscillator circuit for thereby producing output signals indicative of changes in the period of oscillation of said ring oscillator circuit resulting from changes in ambient operating temperature;

a charge pump circuit composed of a capacitor and circuit means responsive to said output signals from said ring oscillator circuit for selectively increasing and decreasing a charge on said capacitor; and a voltage regulating transistor responsive to a voltage developed across said capacitor for regulating said supply voltage from said supply voltage source to produce said controlled supply voltage; said controlled supply voltage being applied to said field effect transistors of said ring oscillator circuit for thereby compensating said changes in propagation time thereof.

* * * * *